US009176435B2

(12) United States Patent
Sakurai et al.

(10) Patent No.: US 9,176,435 B2
(45) Date of Patent: Nov. 3, 2015

(54) BELT UNIT AND IMAGE FORMING APPARATUS HAVING THE BELT UNIT

(75) Inventors: Hiromi Sakurai, Suntou-gun (JP); Eiichiro Kimizuka, Mishima (JP); Yuichiro Inaba, Chigasaki (JP); Yasuhiro Fukase, Kawasaki (JP); Toshiyuki Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 921 days.

(21) Appl. No.: 13/211,067

(22) Filed: Aug. 16, 2011

(65) Prior Publication Data

US 2012/0045245 A1 Feb. 23, 2012

(30) Foreign Application Priority Data

Aug. 20, 2010 (JP) ..... 2010-185293

(51) Int. Cl.
*G03G 15/16* (2006.01)

(52) U.S. Cl.
CPC ..... *G03G 15/1615* (2013.01)

(58) Field of Classification Search
CPC ..... G03G 16/05; G03G 16/15
USPC ..... 399/121, 302
See application file for complete search history.

(56) References Cited

U.S. PATENT DOCUMENTS

| | | | |
|---|---|---|---|
| 6,321,052 | B1 | 11/2001 | Yamashina et al. |
| 2007/0059055 | A1 | 3/2007 | Iwata |

FOREIGN PATENT DOCUMENTS

| | | | | |
|---|---|---|---|---|
| CN | 1403881 | A | | 3/2003 |
| CN | 1885195 | A | | 12/2006 |
| JP | 59015971 | A | * | 1/1984 |
| JP | 2005-091725 | A | | 4/2005 |
| JP | 2005091725 | A | * | 4/2005 |
| JP | 2007-057953 | A | | 3/2007 |
| JP | 2007-212814 | A | | 8/2007 |
| JP | 2007-286606 | A | | 11/2007 |
| JP | 2008-268452 | A | | 11/2008 |
| JP | 2009-075350 | A | | 4/2009 |
| JP | 2009075350 | A | * | 4/2009 |

OTHER PUBLICATIONS

Mizuno et al. (JP 2009-075350 A), Apr. 2009, JPO Computer Translation.*

* cited by examiner

*Primary Examiner* — Erika J Villaluna
(74) *Attorney, Agent, or Firm* — Canon U.S.A., Inc. IP Division

(57) ABSTRACT

A belt unit used for an image forming apparatus is provided. The belt unit includes a rotatable endless belt, a plurality of stretching members configured to stretch the belt, an urging member, and a contact and separation unit configured to be able to switch a position of the stretching member urged by the urging member. In moving the stretching member urged by the urging member from the separation position to the contact position, the contact and separation unit makes one end side of the stretching member urged by the urging member in a longitudinal direction coming into contact with the inner surface of the belt faster than the other end side, and temporarily decreases the movement speeds of the both ends of the stretching member in the longitudinal direction respectively before arriving at the contact position.

11 Claims, 9 Drawing Sheets

BELT UNIT AND IMAGE FORMING APPARATUS HAVING THE BELT UNIT

BACKGROUND OF THE INVENTION

1. Field of the Invention

The present invention relates to an image forming apparatus having a belt unit.

2. Description of the Related Art

Conventionally, configurations of stretching the inner surface of an endless belt using a plurality of stretching members have been known. Japanese Patent Application Laid-Open No. 2007-057953 discusses an image forming apparatus having a mechanism for moving at least one of a plurality of stretching members to a position where tension of a belt goes slack, and using the mechanism to cause the tension of the belt to be released.

In some cases, the image forming apparatus may not be used by users for a long time after the production of the image forming apparatus. For the above reason, configurations in which the tension of the belt is loosened at the time of manufacture, and the tension is applied to the belt at initial installation by a user have been known. For example, Japanese Patent Application Laid-Open No. 2007-286606 discusses an image forming apparatus having a mechanism for applying tension to a belt using power of a user when the user pulls a paper feed cassette of the image forming apparatus out of the apparatus body at initial installation.

However, in the known configurations, problems may occur in making the stretching member come in contact with the belt to set the tension of the belt at high level. In the configuration in Japanese Patent Application Laid-Open No. 2007-057953, one of the plurality of stretching members is moved while the relation with the other stretching members is kept in parallel, and the stretching members come in contact with the belt at the same time at the entire area in the axis direction. Accordingly, the impact in stretching the belt is large. Further, in controlling the positions of the stretching members using the cam discussed in Japanese Patent Application Laid-Open No. 2007-057953, due to a large impact generated when the stretching members come in contact with the belt, the cam may move. Then, the positions of the stretching members may not be kept at the regular positions.

As discussed in Japanese Patent Application Laid-Open No. 2007-286606, in the configuration the tension is applied to the belt using the user's power, depending on the power of the user, the impact due to the contact of the stretching members with the belt increases.

As described above, the large impact in stretching the belt may not only cause damage to the belt, but also cause an impact sound unpleasant to the users.

SUMMARY OF THE INVENTION

The present invention is directed to reducing damage and impact sound generated when stretching members come in contact with a belt by reducing impact in stretching the belt.

According to an aspect of the present invention, a belt unit used for an image forming apparatus is provided. The belt unit includes a rotatable endless belt, a plurality of stretching members configured to stretch the belt, an urging member configured to urge at least one of the stretching members from an inner surface side to an outer surface side of the belt, and a contact and separation unit configured to switch a position of the stretching member urged by the urging member to a contact position to come into contact with the inner surface of the belt or a separation portion for separating from the inner surface of the belt. In moving the stretching member urged by the urging member from the separation position to the contact position, the contact and separation unit makes one end side of the stretching member urged by the urging member in a longitudinal direction contact with the inner surface of the belt faster than the other end side, and temporarily decreases a movement speed of each of the both ends of the stretching member in the longitudinal direction respectively before arriving at the contact position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
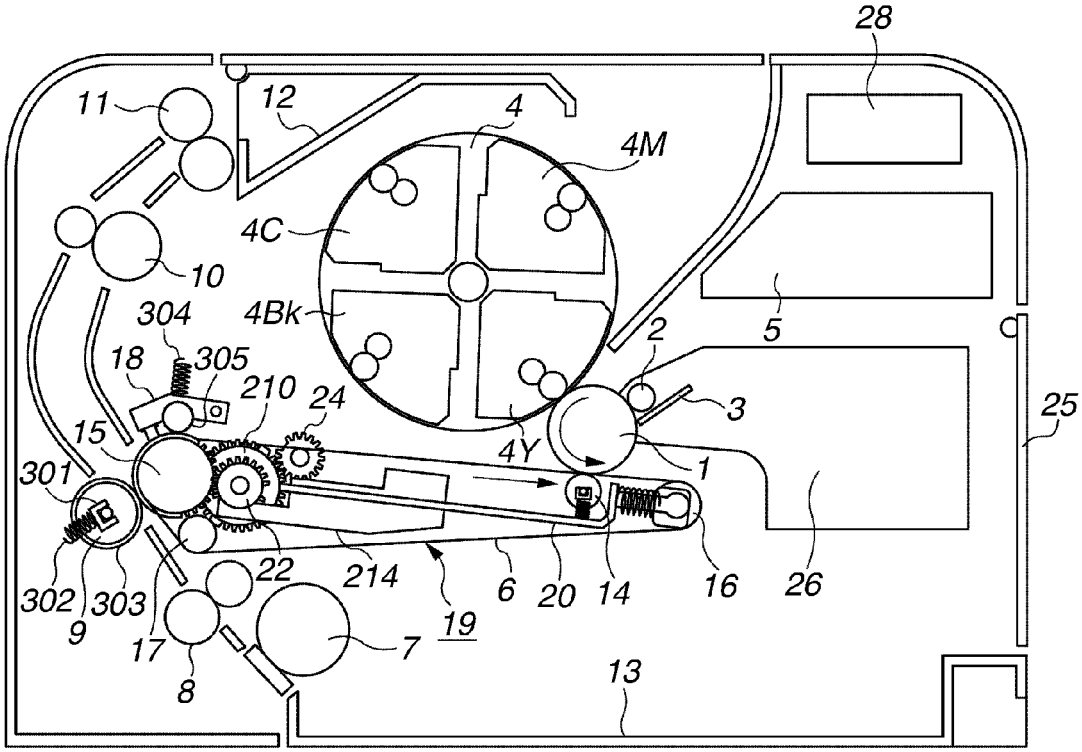
FIG. 1 illustrates an image forming apparatus according to a first exemplary embodiment.

FIG. 1 is a cross sectional view illustrating an electrophotographic image forming apparatus according to the exemplary embodiment. As illustrated in FIG. 1, as the electrophotographic image forming apparatus according to the exemplary embodiment, an example of a four-cycle type full-color laser printer of a rotary type is described.

The image forming apparatus illustrated in FIG. 1 includes, in the body, at least an image carrier 1, an exposure unit 5, a plurality of developing devices 4Y, 4M, 4C, and 4Bk, a rotary developing device unit 4 for holding each development device, an intermediate transfer belt unit 19, and a fixing device 10. In the exemplary embodiment, the image carrier is the photosensitive drum 1 for carrying a toner image. In each of the developing devices 4Y, 4M, 4C, and 4Bk, toner of yellow, magenta, cyan, and black is filled respectively. The photosensitive drum 1, a charging device 2, and a cleaning blade 3 for the photosensitive drum 1 are integrated to form a photosensitive unit 26. Further, the image forming apparatus includes a controller 28 that serves as a control unit.

The belt unit according to the exemplary embodiment is the intermediate transfer belt unit 19. The intermediate transfer belt unit 19 includes at least a rotatable endless intermediate transfer belt 6 and a plurality of stretching members for stretching the intermediate transfer belt 6. The stretching members include a drive roller 15 for driving the intermediate transfer belt 6, a first driven roller (tension roller) 16, and a second driven roller 17. The intermediate transfer belt unit 19 includes a primary transfer member 14 that is provided on the inner surface of the intermediate transfer belt 6, and the member is opposed to the photosensitive drum 1 across the intermediate transfer belt 6, and forms a primary transfer nip portion.

At a position opposed to the drive roller 15 across the intermediate transfer belt 6, a secondary transfer member 9 is provided.

In transferring a toner image to a transfer material, the photosensitive drum 1 is rotated in the arrow direction (counterclockwise direction) in FIG. 1, then, in synchronization with the rotation, the intermediate transfer belt 6 is rotated in the same direction by the drive roller 15. The surface of the photosensitive drum 1 is uniformly charged by the charging device 2. Then, the photosensitive drum is exposed by the exposure unit 5. More specifically, first, an exposure for forming a yellow image is performed on the photosensitive drum 1, and the yellow electrostatic latent image is formed on the photosensitive drum 1. Simultaneously with the electrostatic latent image formation, the rotary developing device 4 is driven to position the developing device 4Y for yellow at a development position (the state illustrated in FIG. 1). Then, electric voltage of the same polarity as the charging polarity on the photosensitive drum 1 and substantially the same potential is applied to the developing device 4Y such that a yellow toner adheres to the electrostatic latent image on the photosensitive drum 1. The yellow tonner adheres to the electrostatic latent image, and the image is developed. Then, electric voltage of the reverse polarity of the toner is applied to the primary transfer roller 14 that is a primary transfer member in the intermediate transfer belt unit 19, and primary transfer of the yellow toner image on the photosensitive drum 1 to the intermediate transfer belt 6 is performed.

In response to the completion of the primary transfer of the yellow toner image described above, the rotary developing device 4 rotates and positions such that the developing device 4M is opposed to the photosensitive drum 1, a magenta toner image is developed on the photosensitive drum 1, and the primary transfer of the image to the intermediate transfer belt is performed similarly to the case of yellow. With respect to each color of cyan and black, similarly, the formation of an electrostatic latent image, the development, and the primary transfer is sequentially performed, and the toner images of four colors are overlapped on the intermediate transfer belt 6.

While the toner images of four colors are overlapped on the intermediate transfer belt 6, the secondary transfer roller 9 that serves as a secondary transfer member is in non-contact state with the intermediate transfer belt 6. At the time, a cleaning unit 18 for collecting the toner remaining on the intermediate transfer belt 6 is positioned in a state the unit is in non-contact with the intermediate transfer belt 6. The position regulation of the secondary transfer roller 9, the cleaning unit 18, and the intermediate transfer belt 6 is described below.

After the primary transfer of the toner image of the fourth color from the photosensitive drum 1 onto the intermediate transfer belt 6 is started, the secondary transfer roller 9 comes in contact with the intermediate transfer belt 6. Further, in synchronization with the rotation of the intermediate transfer belt 6, from a stacking unit 13 that stacks a plurality of transfer materials, the transfer material is separated and fed one by one by a pickup roller 7. The fed transfer material is stopped at a predetermined position by a pair of conveyance rollers 8, and then, conveyed toward the nip portion of the intermediate transfer belt 6 and the secondary transfer roller 9 at predetermined timing. To the secondary transfer roller 9, an electric voltage of the reverse polarity of the toner is applied, and secondary-transfer of the toner image on the intermediate transfer belt 6 to the surface of the conveyed transfer material is performed collectively.

The transfer material on which the secondary-transfer is performed as described above is conveyed to the fixing device 10, and the toner image is fixed onto the transfer material. Then, the transfer material is discharged to a discharge tray 12 in an upper part of the image forming apparatus by a discharge roller pair 11, and the image formation ends. Generally, on the intermediate transfer belt, residual toner that has not been transferred to the transfer material and still remaining exists. The residual toner is charged with the reverse polarity to the polarity during the transfer by the cleaning unit 18 that comes in contact with the intermediate transfer belt 6 after the secondary transfer.

The residual toner that has been charged with the reverse polarity is electrostatically transferred to the photosensitive drum 1 at the primary transfer nip portion. Then, the residual toner is collected in a photosensitive unit 26 by a cleaning blade 3 for photosensitive drum 1.

The drive roller 15 is wider than the secondary transfer roller 9 in the width direction, and wider than the contact portion of the cleaning unit 18 to the intermediate transfer belt 6. The surface of the drive roller 15 is coated with a rubber having low electric resistance. The drive roller 15 serves as an opposite electrode of the secondary transfer roller 9 and the cleaning unit 18.

Figure 2:
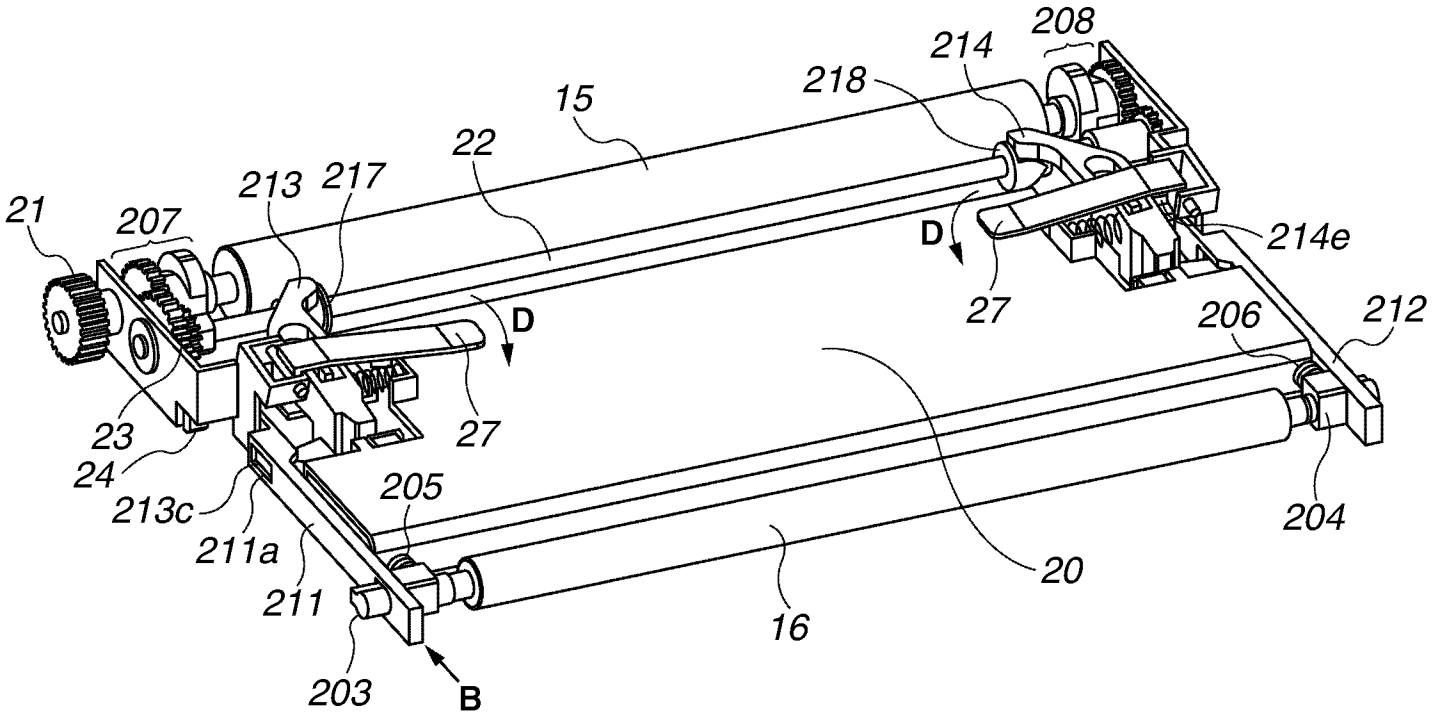
FIG. 2 is a perspective view illustrating an intermediate transfer belt unit.
Figure 3:
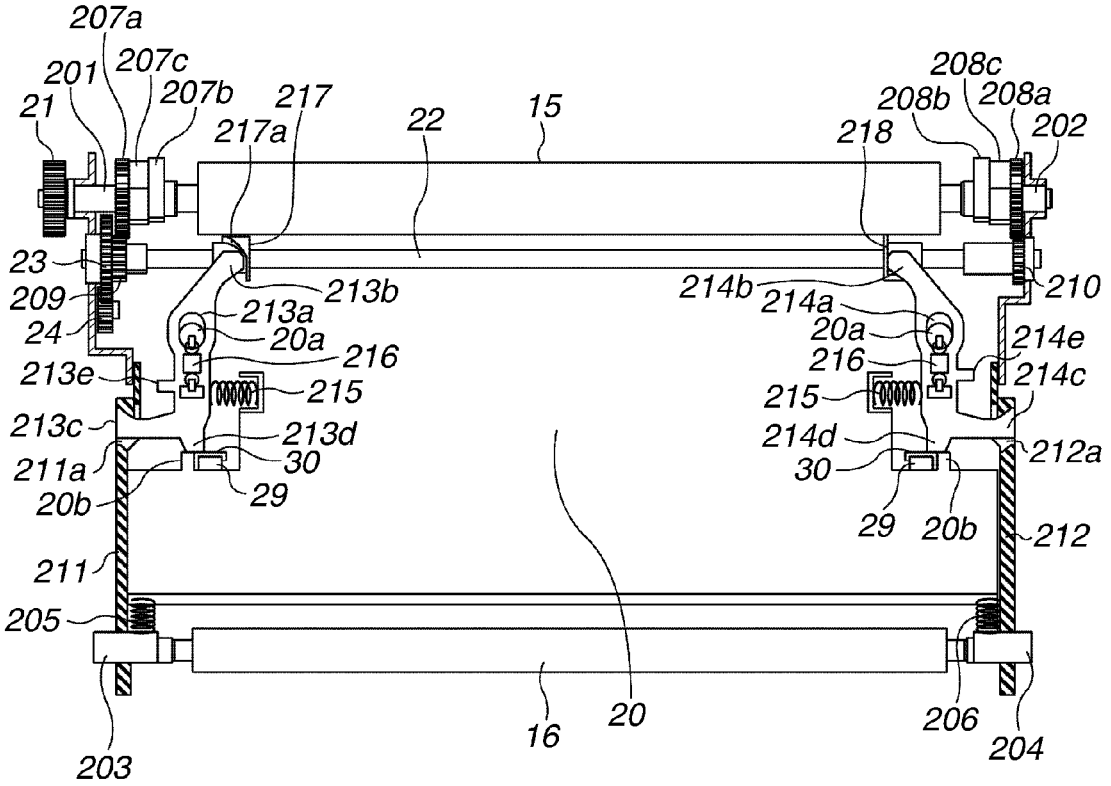
FIG. 3 is a cross sectional view illustrating the intermediate transfer belt unit.

The intermediate transfer belt unit 19 is described in detail with reference to FIG. 2 and FIG. 3. FIG. 2 is a perspective view illustrating a state in which the belt is removed from the intermediate transfer belt unit 19. FIG. 3 is a cross sectional view illustrating the state in which the belt is removed from the intermediate transfer belt unit 19. FIGS. 2 and 3 illustrate the internal mechanism, and the intermediate transfer belt 6 and the second driven roller 17 are not illustrated.

The drive roller 15 is rotatably held to an intermediate transfer belt frame 20 by a right side bearing 201 and a left side bearing 202 at the both ends. Through a drive gear 21 (at the left side in FIG. 2), predetermined rotary drive can be transmitted from the apparatus body.

A bearing 203 and a bearing 204 are provided to both ends of the primary driven roller 16 that is one of the plurality of stretching members. The bearings 203 and 204 are urged by springs 205 and 206 that serve as urging members. With the configuration, the first driven roller is urged from the inner surface side to the outer surface side of the belt by the urging members, and predetermined tension is applied to the intermediate transfer belt 6.

In the vicinity of the both ends on the shaft of the drive roller 15, phase cams 207 and 208 are rotatably held to the drive roller 15. The phase cam 207 includes a gear portion 207*a*, a secondary transfer roller position regulating cam portion 207*b*, and a cleaning unit position regulating cam portion 207*c*. The phase cam 208 has the symmetrical shape.

By the phase cams 207 and 208, the secondary transfer roller 9 and the cleaning unit 18 come in contact with the intermediate transfer belt 6 or separate from the intermediate transfer belt 6.

A cam drive shaft 22 is rotatably held to the intermediate transfer belt frame 20 at the both ends. Through a camshaft drive gear 23 and an idler gear 24 of the right side, predetermined rotary drive is transmitted from the apparatus body. In the vicinity of the both ends of the cam drive shaft 22, gears 209 and 210 are integrated with the cam drive shaft 22 in the same phase and in the symmetrical shape. The gear 209 transmits the rotary drive to the gear portion 207*a* of the phase cam 207, and the gear 210 transmits the rotary drive to the gear portion 208*a* of the phase cam 208. Gear connection portions of the each gear are phase-controlled and assembled. By the configuration, the phase cams 207 and 208 rotate in the same phase with rotation of the cam drive shaft 22. In the drive transmission gears 209 and 210, belt stretching cams 217 and 218 are integrated with the cam drive shaft 22. The belt stretching cams 217 and 218 are described in detail below. In the exemplary embodiment, the cam drive shaft 22, the camshaft drive gear 23, the idler gear 24, and the like configure a drive transmission unit for driving the phase cams 207 and 208. The drive transmission unit for driving the phase cams 207 and 208 may omit the cam drive shaft 22. Specifically, the drive force can be directly transmitted from a drive source to the phase cams 207 and 208 respectively using gears, or the like.

As illustrated in FIG. 1, the secondary transfer roller 9 is rotatably held to the apparatus body at the both ends by a bearing 301. By a secondary transfer roller spring 302, the secondary transfer roller 9 is urged in a direction coming in contact with the drive roller 15. In the vicinity of the both ends on the shaft of the secondary transfer roller 9, a roller 303 is rotatably held to the secondary transfer roller 9, and slides with secondary transfer roller position regulating cam portions 207*b* and 208*b*. The secondary transfer roller 9 can move to a position coming in contact with the drive roller 15 or a position separating from the drive roller 15 depending on a phase of the secondary transfer roller position regulating cam portions 207*b* and 208*b*.

The cleaning unit 18 is rotatably held to the intermediate transfer belt frame 20 at the both ends. The cleaning unit 18 is urged in a direction coming in contact with the drive roller 15 by a cleaning unit spring 304. Protrusions 305 provided at the both ends of the cleaning unit 18 slide with cleaning unit position regulating cam portions 207*c* and 208*c*. The cleaning unit 18 can move to a position coming in contact with the drive roller 15 or a position separating from the drive roller 15 depending on a phase of the cleaning unit position regulating cam portions 207*c* and 208*c*.

In one rotation, the phase cams 207 and 208 move the secondary transfer roller 9 and the cleaning unit 18 to the position separating from the drive roller 15, and only the secondary transfer roller 9 to the position coming in contact with the drive roller 15. Further, the phase cams 207 and 208 move the secondary transfer roller 9 and the cleaning unit 18 to the position coming in contact with the drive roller 15. The secondary transfer roller 9 and the cleaning unit 18 shift these three states in this order. The positions of the secondary transfer roller 9 and the cleaning unit 18 are switched to one of the three states in each one rotation of the idler gear 24. Rotation of an apparatus body driveline (not shown) for transmitting drive force to the idler gear 24 is controlled by a solenoid. The drive force is transmitted to the idler gear 24 only when the positions of the secondary transfer roller 9 and the cleaning unit 18 are switched.

A contact and separation unit for switching the stretched state of the intermediate transfer belt 6 is described with reference to FIGS. 1 to 4. The contact and separation unit can switch the position of the driven roller 16 to a position the driven roller 16 comes in contact with the inner surface of the belt and a position the driven roller 16 separates from the inner surface of the belt. The contact and separation unit includes a holding member for holding an end of the driven roller 16, a regulating member for regulating the position of the holding member, and a pressing member for pressing the regulating member. Further, the contact and separation unit includes at least a drive transmission member for coming in contact with an end of the regulating member and moving the regulating member in a direction opposite to the pressing direction of the pressing member, and a shock-absorbing member for reducing moving force of the regulating member that is moved by the drive transmission member. The contact and separation unit according to the exemplary embodiment includes the holding member, the regulating member, the pressing member, the drive transmission member, and the shock-absorbing member at each side of the both ends in the longitudinal direction of the driven roller 16 respectively.

Figure 4:
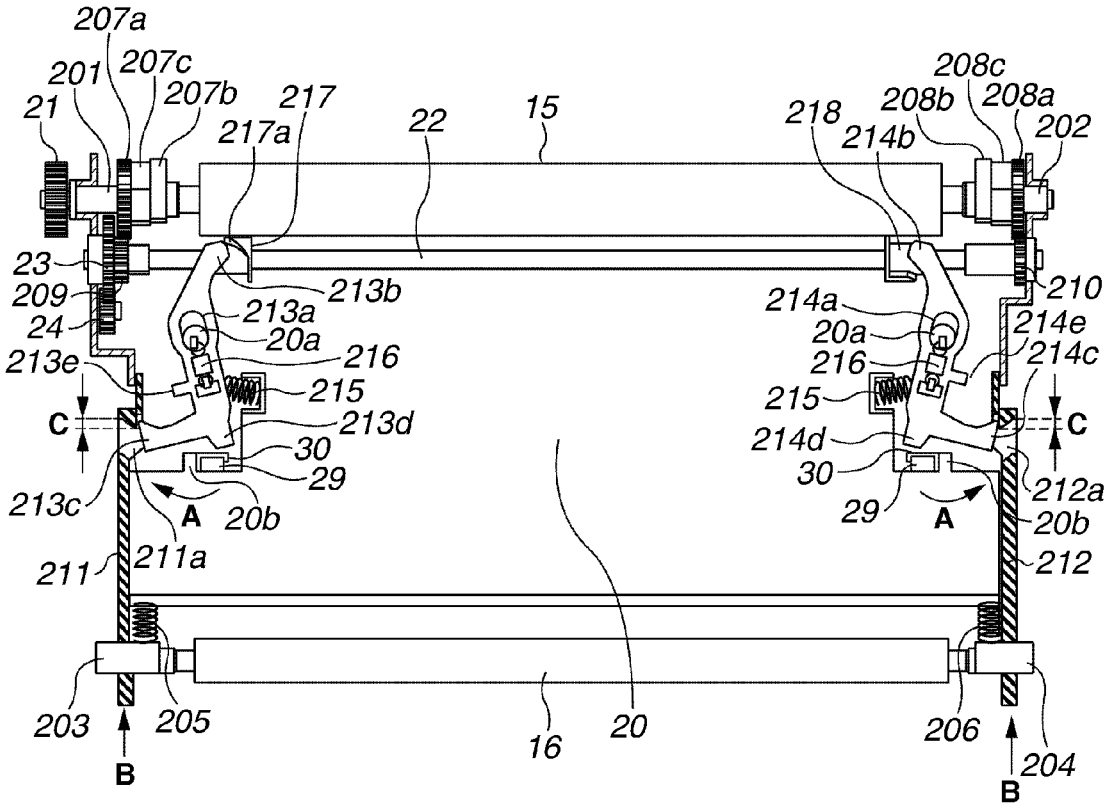
FIG. 4 is a cross sectional view illustrating the intermediate transfer belt unit.

FIGS. 2 and 3 illustrate states where the driven roller is separated from the intermediate transfer belt 6 and the stretched state of the intermediate transfer belt 6 is released. FIG. 4 illustrates a state where the driven roller comes in contact with the intermediate transfer belt 6 and the intermediate transfer belt 6 is being stretched. Tension release levers 211 and 212 serve as the holding member. The tension release levers 211 and 212 are connected to the bearings 203 and 204 that are provided at both ends of the driven roller 16 respectively.

Tension release links 213 and 214 serve as the control member. Long hole portions 213*a* and 214*a* are held in a state slidably fit to boss portions 20*a* of the intermediate transfer belt frame 20. The tension release links 213 and 214 receive urging force from the intermediate transfer belt frame 20 by compression springs 215 and extension springs 216. Specifically, the tension release links 213 and 214 are pressed by force in directions from the central part of the intermediate transfer belt frame 20 toward each end part side by the compression springs 215 that serve as the pressing member.

Cam sliding portions 213*b* and 214*b* of the tension release links 213 and 214 slide with the belt stretching cams 217 and 218 respectively that serve as the drive transmission member. By rotation of the cam drive shaft 22, the orientation of the tension release links 213 and 214 changes. The orientation of the tension release links 213 and 214 can be changed within the plane of the cross sectional view illustrated in FIGS. 3 and 4. The action of the belt stretching cams is described below.

To begin with, release of the stretched state of the intermediate transfer belt 6 by moving the driven roller from the intermediate transfer belt 6 to the separation position by the contact and separation unit is described. First, the tension release levers 211 and 212 are moved toward the arrow B direction in FIG. 4. As illustrated in FIG. 4, the tension release links 213 and 214 are pressed in the arrow A directions by the compression springs 215 respectively. Accordingly, if the tension release levers 211 and 212 are moved the length C or more in the arrow B direction, engaging portions 213*c* and 214*c* of the tension release links 213 and 214 are set into hole portions 211*a* and 212*a* of the tension release levers 211 and 212.

As a result, the tension release links 213 and 214 are pressed in the direction opposite to the arrow B by the power of the compression springs 205 and 206 through the tension release levers 211 and 212.

Then, at positions latching portions 213*d* and 214*d* of the tension release links 213 and 214 hit against protrusions 20*b* of the intermediate transfer belt frame 20, the force applied to the tension release links 213 and 214 balances with each other. The positions illustrated in FIG. 3 are the positions where the force applied to the tension release links 213 and 214 balances with each other, and the state the positions of the tension release links 213 and 214 are surely regulated. By regulating the positions of the tension release links 213 and 214 with the protrusion portions, even if some load changes act on the intermediate transfer belt 6 in the releasing operation, change in the positions of the tension release links 213 and 214 can be prevented.

Figure 5A:
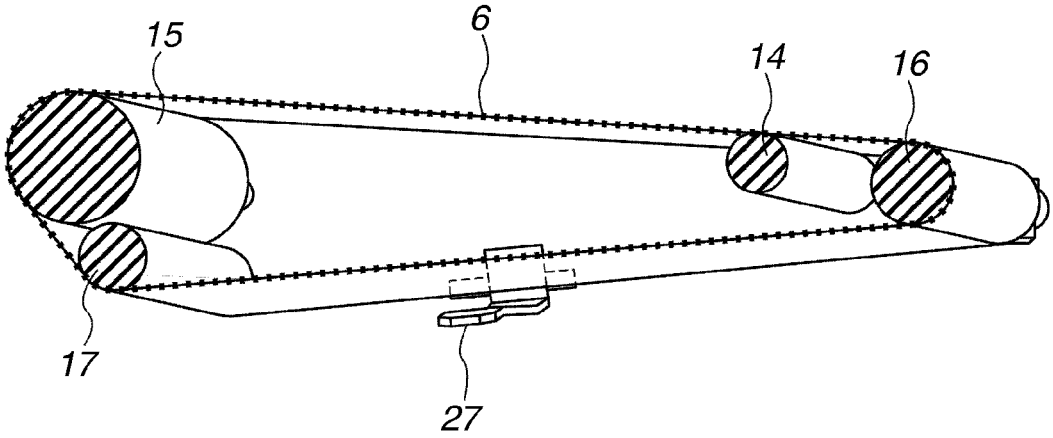
FIGS. 5A and 5B illustrate a holding member of the intermediate transfer belt.

Protrusions 213*e* and 214*e* rotate belt holding members 27 (belt regulating members 27) in the arrow D direction illustrated in FIG. 2 by the rotation of the tension release links 213 and 214 to the A directions. The belt holding members 27 are rotatably held to the intermediate transfer belt frame 20 outside the both ends of the intermediate transfer belt 6 in the longitudinal direction. In the state the intermediate transfer belt 6 is stretched, the belt holding members 27 do not apply any regulation to the tension release links 213 and 214. In the exemplary embodiment, as illustrated in FIG. 5A, in the state the intermediate transfer belt 6 is stretched, the belt holding members 27 keep the positions separated from the intermediate transfer belt 6 under its own weight.

Figure 5B:
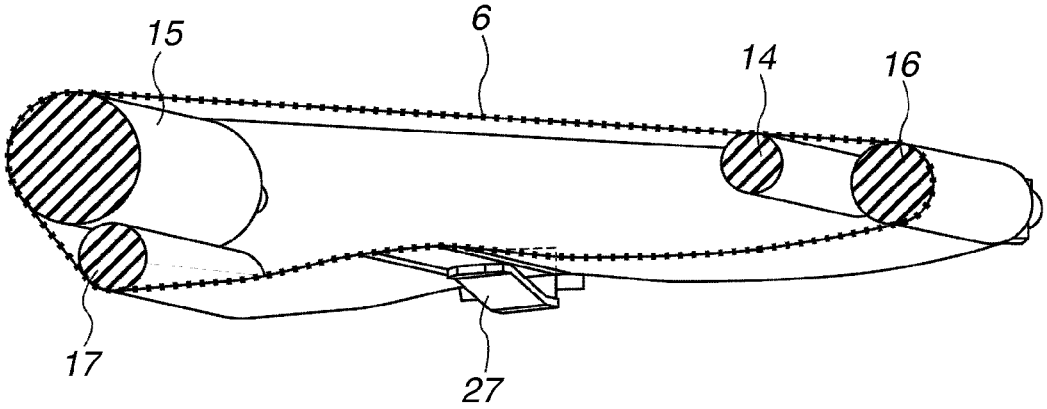

If the tension release links 213 and 214 rotate to release the stretched state of the intermediate transfer belt 6, the belt holding members 27 rotate in the arrow D direction. As illustrated in FIG. 5B, the belt holding member 27 supports the intermediate transfer belt 6, that is loosened, between the first driven roller 16 and the second driven roller 17. With the operation, the loosened intermediate transfer belt 6 can be prevented from coming in contact with the other components in the image forming apparatus. In the exemplary embodiment, the intermediate transfer belt 6 is prevented from coming in contact with a mechanical section (for example, the pickup roller 7) that is located below the intermediate transfer belt unit 19.

Next, change of the state of the intermediate transfer belt 6 from the state the stretched state is released to the stretched state is described with reference to FIGS. 6A to 6F.

If electric power is supplied to a power source unit (not shown), a solenoid is set by a controller 28, and the cam drive shaft 22 rotates. The operation of the belt stretching cam 217 and the tension release link 213 at the time is described with reference to FIGS. 6A to 6F. The operation of the belt stretching cam 218 and the tension release link 214 is similar to that of the operation of the belt stretching cam 217 and the tension release link 213, and accordingly, the description of the operation is omitted. The belt stretching cams 217 and 218 have symmetrical shapes, and are held in a state their phases with respect to the cam drive shaft 22 are shifted by 180 degrees with each other. Accordingly, the timing a cam face 217*a* of the belt stretching cam 217 comes in contact with a cam sliding portion 213*b* of the tension release link 213 differs from the timing a cam face 218*a* of the belt stretching cam 218 comes in contact with a cam sliding portion 214*b* of the tension release link 214.

FIGS. 6A to 6F illustrate the process the cam face 217*a* of the belt stretching cam 217 comes in contact with the cam sliding portion 213*b* of the tension release link 213 and the tension release link 213 is moved. In the state in FIG. 6A, the cam face 217*a* starts to push the tension release link 213 toward the left side in the drawing. In response to the cam sliding portion 213*b* of the tension release link 213 being pushed by the cam face and moved to the left side in the drawing, a portion 213*c* moves on a tapered portion of the tension release lever 211, and moves in the direction separating from the tension release lever 211 (from the end part to the central part).

Figure 6A:
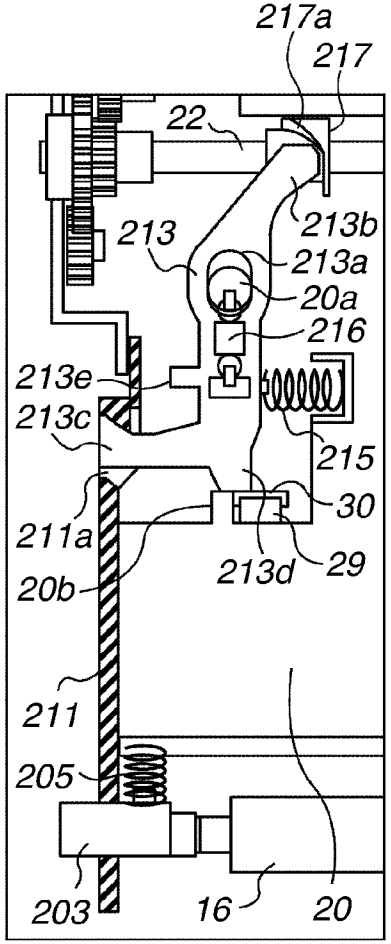
FIGS. 6A to 6F illustrate processes in states the intermediate transfer belt is stretched and states the stretching state is released.
Figure 6B:
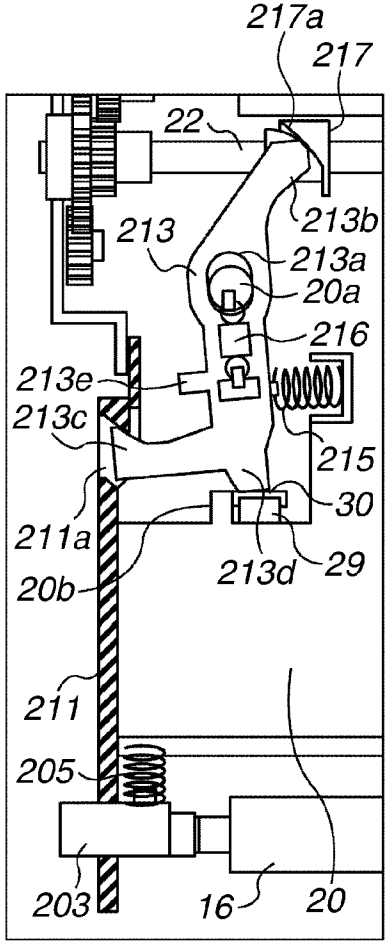

When the tension release link 213 is pushed to the position illustrated in FIG. 6B, by the stretching force of the spring 205, the tension release link 213 separates from the cam face 217*a*, and rotates fast. At the time, to prevent the tension release link 213 from separating at once from the tension release lever 211, a shock-absorbing member 29 is provided to the intermediate transfer belt frame 20.

Figure 6C:
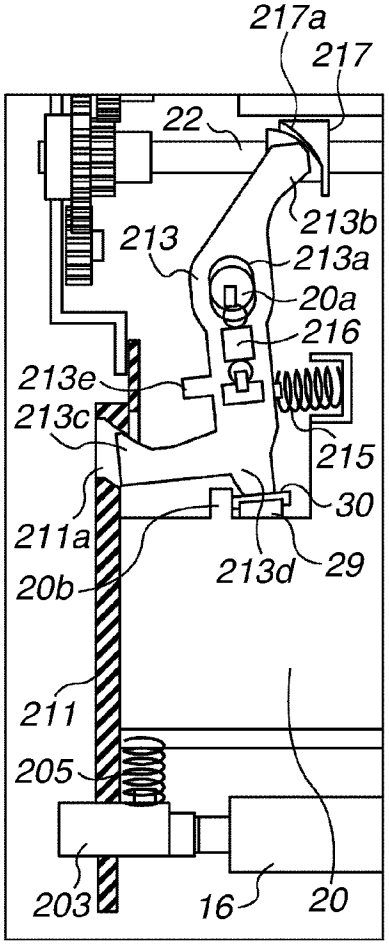
Figure 6D:
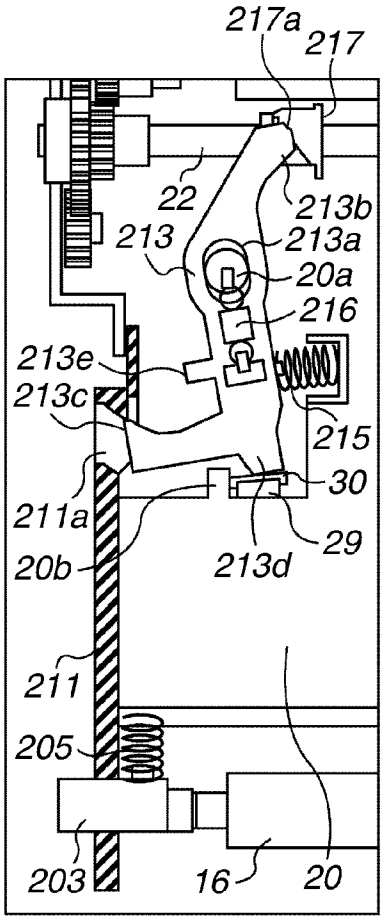

As illustrated in FIG. 6C, the moving speed of the tension release link 213 temporarily decreases due to the resistance force of the shock-absorbing member 29. In the exemplary embodiment, the tension release link 213 is stopped moving temporarily by the resistance force of the shock-absorbing member 29. With the configuration, the driven roller 16 can be restrained from moving instantaneously from the separation position to the contact position movement of.

The frictional sliding face of the shock-absorbing member 29 with the tension release link 213 is covered with a frictional sliding portion 30 composed of a rigid body of low coefficient of friction. The material and shape of the shock-absorbing member 29 are selected such that when the tension release link 213 temporarily stops at the position illustrated in FIG. 6C, the bearing 203 of the primary driven roller 16 is arranged in a substantially intermediate position between the contact position (FIG. 6E) and the separation position (FIG. 6A) of the intermediate transfer belt 6. A position more contact position side than the position substantially intermediate position can be selected.

When the cam drive shaft 22 rotates further, the cam face 217*a* pushes the resistance force of the shock-absorbing member 29, and then, the tension release link 213 is moved again in the direction separating from the tension release lever 211. When the tension release link 213 moves to the position illustrated in FIG. 6D, the engaging portion 213*c* of the tension release link 213 comes off the hole portion 211*a* of the tension release lever 211. As a result, the tension release lever 211 and the bearing 203 of the primary driven roller 16 move to the contact position on the intermediate transfer belt 6 by the spring 205 (the bearing 203 moves in the downward direction in FIG. 6D).

Figure 6F:
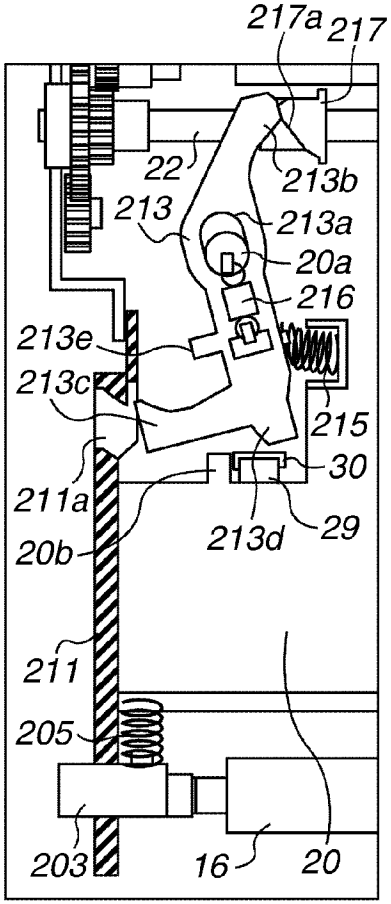
Figure 6E:
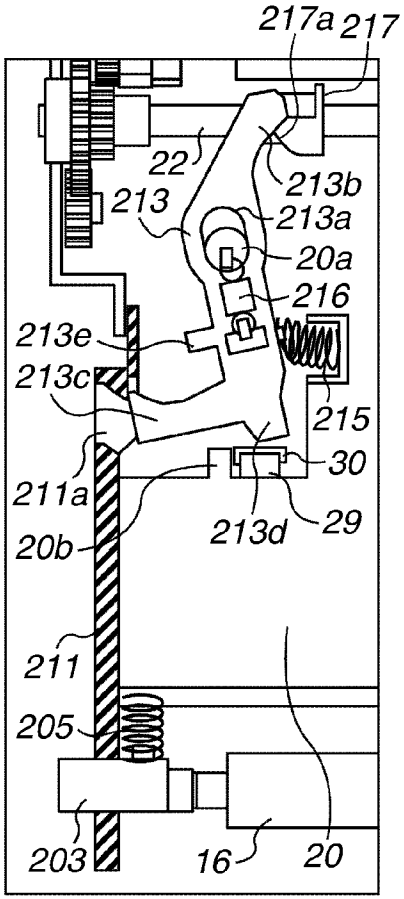

The tension release link 213 rotates to a sufficiently separated position from the tension release lever 211 by the stretching cam 217 as illustrated in FIG. 6F. Then, as illustrated in FIG. 6E, by the compression spring 215, the tension release link 213 returns to a position the tension release link 213 comes in contact with the side surface of the tension release lever 211.

During the operation, the cam face 218*a* of the belt stretching cam 218 does not come in contact with the cam sliding portion 214*b* of the tension release link 214. Accordingly, the tension release link 214 keeps the state in which the stretching force of the intermediate transfer belt 6 is released. When the cam drive shaft 22 rotates further, the cam face 218*a* of the belt stretching cam 218 comes in contact with the cam sliding portion 214*b* of the tension release link 214 and the tension release link 214 is moved. The process is similar to the above-described process of the tension release link 213. Specifically, by the contact and separation unit, the one end side of the driven roller 16 in the longitudinal direction is made to come in contact with the inner face of the belt faster than the other end side, and the movement speeds of the both ends are temporarily decreased before arriving at the contact positions respectively.

Figure 7A:
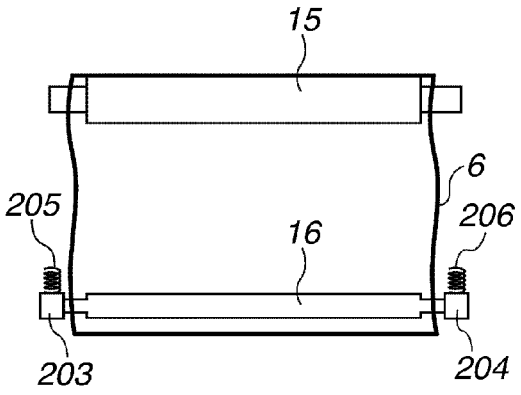
FIGS. 7A to 7E illustrate processes in states the intermediate transfer belt is stretched and states the stretching state is released.
Figure 7B:
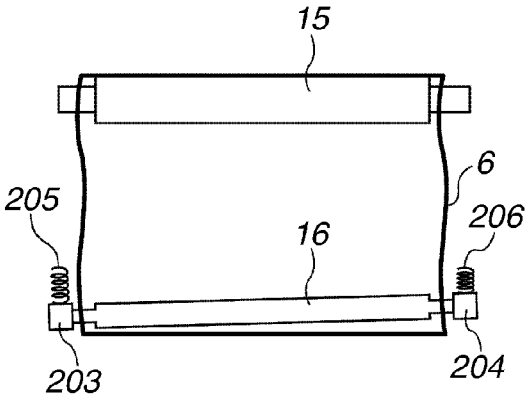
Figure 7C:
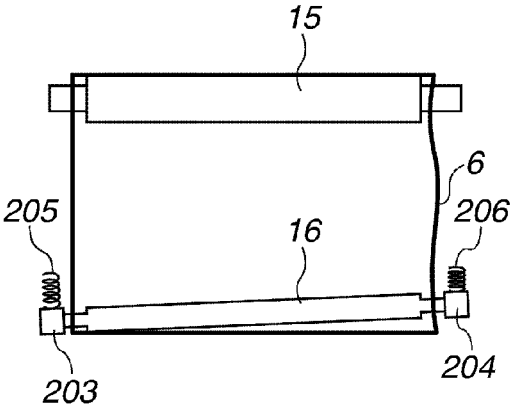
Figure 7D:
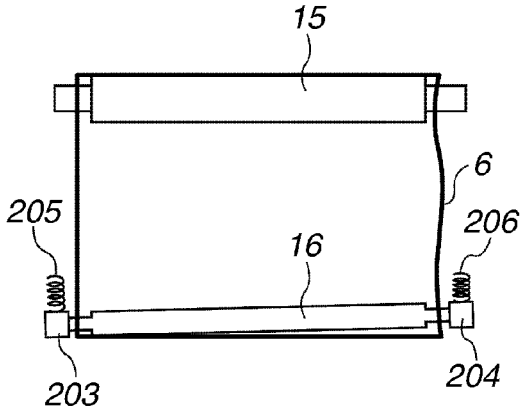
Figure 7E:
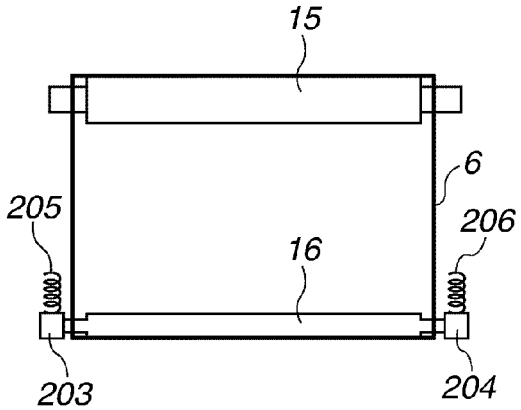

FIGS. 7A to 7E illustrate states from the state in which the stretched state of the intermediate transfer belt is released to the state in which the released state is changed to the stretched state. As illustrated in FIGS. 7B and 7D, the primary driven roller 16 stops once at the both end portions while the driven roller 16 moves from the separation position to the contact position.

In the exemplary embodiment, the belt stretching cams 217 and 218 are disposed such that the phases with respect to the cam drive shaft 22 are shifted by 180 degrees with each other, however, it is not limited to the example. For example, after the tension release link 213 is temporarily stopped at the position in FIG. 6C by the belt stretching cam 217, the tension release link 214 is moved to the same position (the temporary stop position) by the belt stretching cam 218. Then, the tension release link 213 can be moved again to the stretch position of the intermediate transfer belt 6 by the belt stretching cam 217, and finally, the tension release link 214 can be moved to the stretch position of the intermediate transfer belt 6 by the belt stretching cam 218.

Only in the initial installation in which the above-described operation is performed, a drive motor (not shown) connected to the cam drive shaft 22 is operated at a low speed to restrain the movement speed of the tension release links 213 and 214. Once the tension release links 213 and 214 move to the positions for stretching the intermediate transfer belt 6, the state in which the tension release links 213 and 214 urged to the back of the apparatus body is maintained by the extension spring 216 (FIGS. 6E and 6F).

Then, the tension release levers 211 and 212 maintain the state in which the tension release levers 211 and 212 are urged to the front of the apparatus body by the springs 205 and 206. In other word, the tension release links 213 and 214 are prevented from automatically returning to the positions for releasing the stretching force of the intermediate transfer belt 6 by the rotation of the belt stretching cams 217 and 218 once the intermediate transfer belt 6 is stretched. For example, in the state in FIG. 6E, the positions of the tension release links 213 and 214 are to be regulated such that the cam sliding portions 213*b* and 214*b* of the tension release links 213 and 214 do not come in contact with the belt stretching cams 217 and 218 respectively. Further, in a case where the tension release links 213 and 214 are slightly rotated by the belt stretching cams 217 and 218, the engaging portions 213*c* and 214*c* are to be regulated not to be set into the hole portions 211*a* and 212*a* of the tension release levers 211 and 212.

In a case where the apparatus body is packed in a state in which the intermediate transfer belt unit 19 is mounted on the apparatus body, and the apparatus body is shipped, the stretched state of the intermediate transfer belt 6 may be released. In the configuration according to the exemplary embodiment, by simply moving the tension release levers 211 and 212 by an operator, the stretched state of the intermediate transfer belt 6 can be released, and the released state can be maintained with the simple configuration.

Further, even if a large vibration occurs during shipment of the apparatus body, the tension release links 213 and 214 are being pressed by the compression spring 215. With the configuration, even if the large vibration occurs, the engagement state between the hole portions 211*a* and 212*a* of the tension release levers and the portions 213*c* and 214*c* of the tension release links can be maintained.

With the above-described configurations, the stretching force of the belt is applied in the width direction of the belt through multiple steps. Accordingly, the impact sound in the stretching operation can be reduced. Further, the regulating members for regulating the stretching roller positions of the belt are moved through multiple steps, and the drive force necessary in the stretching operation can be reduced.

Further, it is not necessary to newly provide a drive unit for driving the contact and separation unit. Accordingly, the costs and the size of the product are not increased. Further, only at the initial installation, the drive unit is operated at a low speed. Accordingly, the impact sound in stretching the belt can be further decreased.

Figure 8:
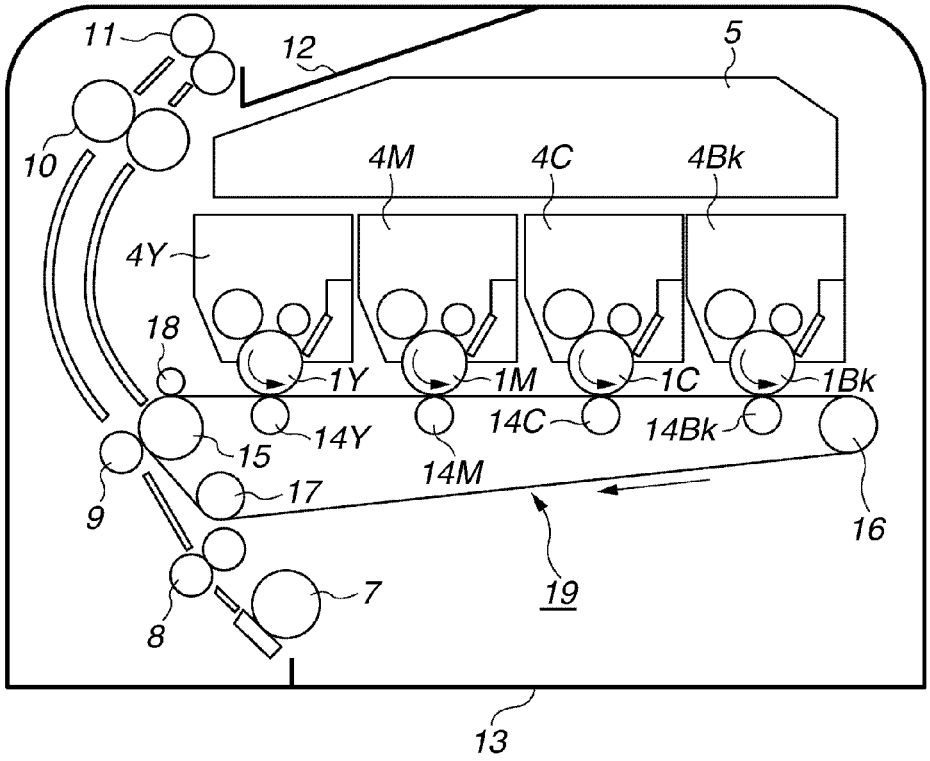
FIG. 8 illustrates another image forming apparatus according to the first exemplary embodiment.

In the exemplary embodiment, the color image forming apparatus of the rotary type in which the development devices rotate, the apparatus having one image carrier (photosensitive drum) and using the intermediate transfer belt has been described. However, the present invention is not limited to the above, the invention can also be applied to a belt unit used for color image formation of a tandem type having a plurality of image carriers and uses the intermediate transfer belt as illustrated in FIG. 8. Further, the present invention can be applied to an image forming apparatus using a belt unit that employs a conveyance belt for bearing and conveying a transfer material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-185293 filed Aug. 20, 2010, which is hereby incorporated by reference herein in its entirety.

What is claimed is:

1. A belt unit used for an image forming apparatus, the belt unit comprising:

a rotatable endless belt;

a drive roller;

an urging member;

a tension roller that is one of a plurality of rollers to stretch the belt and is pressed from an inner periphery to an outer periphery side of the belt by the urging member and configured to apply tension to the belt, wherein the tension roller is a roller disposed at a farthest position from the drive roller among the plurality of rollers; and a contact and separation unit configured to switch a position of the tension roller to a contact position to come into contact with the inner surface of the belt, or a separate position for separating from the inner surface of the belt, wherein, the contact and separation unit comprises a shock-absorbing member and a regulating member configured to regulate the position of the tension roller in an urged direction, and wherein, in a case where moving a position of the tension roller from the separation position to the contact position, the regulating member moves and the shock-absorbing member reduces the movement speed of the regulating member by making contact with the regulating member.

2. The belt unit used for the image forming apparatus according to claim 1, wherein the contact and separation unit comprises:

a holding member configured to hold one end of the tension roller and be engaged to the regulating member;

a spring configured to pull the regulating member in a direction away from the holding member; and a drive transmission member configured to transmit a drive force from the drive roller to the regulating member, wherein, in a case where moving a position of the tension roller from the separation position to the contact position, engagement of the regulating member to the holding member is released according to a driving force transmitted from the drive transmission member and the spring.

3. The belt unit used for the image forming apparatus according to claim 1, wherein the contact and separation unit has the regulating member, the shock-absorbing member, the holding member, the spring, and the drive transmission member at each of both end sides of the tension roller in a longitudinal direction.

4. The belt unit used for the image forming apparatus according to claim 3, wherein, when moving the tension roller from the separate position to the contact position, the contact and separation unit makes one end side of the tension roller in a longitudinal direction come into contact with the inner surface of the belt faster than the other end side.

5. An image forming apparatus comprising:

a rotatable endless belt;

a drive roller that is one of a plurality of rollers to stretch the belt and configured to drive the belt;

an urging member;

a tension roller that is one of a plurality of rollers to stretch the belt and is pressed from an inner periphery to an outer periphery side of the belt by the urging member and configured to apply tension to the belt, wherein the tension roller is a roller disposed at a farthest position from the drive roller among the plurality of rollers; and a contact and separation unit configured to switch a position of the tension roller to a contact position to come into contact with the inner surface of the belt, or a separate position for separating from the inner surface of the belt, wherein, the contact and separation unit comprises a shock-absorbing member and a regulating member configured to regulate the position of the tension roller in an urged direction, and wherein, in a case where moving a position of the tension roller from the separation position to the contact position, the regulating member moves and the shock-absorbing member reduces the movement speed of the regulating member by making contact with the regulating member.

6. The image forming apparatus according to claim 5, wherein the contact and separation unit comprises:

a holding member configured to hold one end of the tension roller and be engaged to the regulating member;

a spring configured to pull the regulating member in a direction away from the holding member;

a drive transmission member configured to transmit a drive force from the drive roller to the regulating member, wherein, in a case where moving a position of the tension roller from the separation position to the contact position, engagement of the regulating member to the holding member is released according to a driving force transmitted from the drive transmission member and the spring.

7. The image forming apparatus according to claim 6, wherein the contact and separation unit has the regulating member, the shock-absorbing member, the holding member, the spring, and the drive transmission member at each of both end sides of the tension roller in a longitudinal direction.

8. The image forming apparatus according to claim 7, wherein, when moving the tension roller from the separate position to the contact position, the contact and separation unit makes one end side of the tension roller in a longitudinal direction come into contact with the inner surface of the belt faster than the other end side.

9. The image forming apparatus according to claim 5, wherein the belt is an intermediate transfer belt onto which the toner image is transferred from the image carrier.

10. The image forming apparatus according to claim 5, further comprising a secondary transfer member configured to come into contact with an outer surface of the intermediate transfer belt and perform secondary transfer of the toner image from the intermediate transfer belt to a recording material.

11. The image forming apparatus according to claim 10, further comprising a cam configured to make the secondary transfer member come into contact with or to separate the secondary transfer member from the intermediate transfer belt.

* * * * *